US005185972A

United States Patent [19]

Markiewicz

[11] Patent Number: 5,185,972

[45] Date of Patent: Feb. 16, 1993

[54] MODULAR CANOPY

[76] Inventor: Richard A. Markiewicz, 17729 Lewis Rd., Cement City, Mich. 49233

[21] Appl. No.: 661,208

[22] Filed: Feb. 27, 1991

[51] Int. Cl.[5] ..... E04B 1/12; E04B 15/18

[52] U.S. Cl. ..... 52/63; 52/90; 52/73; 52/646; 135/101; 135/105; 135/908

[58] Field of Search ..... 52/2.18, 2.21, 63, 646, 52/648, 650, 90, 97, 639, 73; 135/101, 105, 106, 107, 112, 115, 102, DIG. 8, DIG. 9

[56] References Cited

U.S. PATENT DOCUMENTS

| | | | |
|---|---|---|---|
| 493,305 | 3/1893 | Sherman . | |
| 498,583 | 5/1893 | Smawley et al. . | |
| 2,130,919 | 9/1938 | Erickson et al. | 135/106 X |
| 2,808,065 | 10/1957 | Ellis | 135/5 |
| 2,845,078 | 7/1958 | Singleton | 135/106 |
| 3,023,732 | 3/1962 | Everett | 119/16 |
| 3,182,672 | 5/1965 | Biller, Jr. | 135/105 X |
| 4,285,355 | 8/1981 | Lundblade | 135/105 |
| 4,347,690 | 9/1982 | Wallace, Jr. . | |
| 4,683,901 | 8/1987 | Mitchell | 135/101 X |
| 4,726,153 | 2/1988 | Adler et al. | 52/63 |
| 4,865,066 | 9/1989 | Brooks . | |

FOREIGN PATENT DOCUMENTS

| | | | |
|---|---|---|---|
| 1122223 | 1/1962 | Fed. Rep. of Germany | 135/106 |

*Primary Examiner*—David A. Scherbel
*Assistant Examiner*—Kien Nguyen
*Attorney, Agent, or Firm*—Beaman & Beaman

[57] ABSTRACT

An all-purpose modular canopy system including a canopy frame formed of a plurality of interconnected sections, the sections being formed of welded tubular elements. The sections are modular in configuration including end and central portions whereby the sections may be selectively assembled to produce the desired length. The canopy frame includes transversely disposed brace elements associated with supporting columns and adjustable fittings to facilitate alignment of the columns and canopy frame, and the canopy frame is covered by a flexible covering using a lacing system between the frame and covering to maintain covering tension. The covering may include a skirt cooperating with skirt stabilizers formed in the canopy frame corners for maintaining the skirt properly oriented.

17 Claims, 12 Drawing Sheets

MODULAR CANOPY

BACKGROUND OF THE INVENTION

Canopies mounted upon columns are commonly employed to form lightweight shelters. The canopy basically consists of a roof portion supported by vertically extending columns disposed below the assembled roof portion. The canopy roof portion may be defined by relatively rigid components, such as panels, or may consist of a framework covered by a flexible cover or tarpaulin. In many installations the sides of a canopy shelter are open, but it is also known to enclose the sides of the canopy shelter with fabric such as tent material.

Currently, canopies are widely used as shelters for automobiles, motor homes, picnic tables, boats, and the like, and canopies are often mounted upon boat lifting devices to protect the boat from the weather when lifted from the water surface.

Various types of canopy constructions are shown in U.S. Pat. Nos. 493,305; 498,583; 3,023,732; 4,347;690 and 4,865,066.

Canopies serve well as a lightweight shelter for a number of purposes and a popular canopy construction consists of a column supported framework over which a flexible cover such as a tarpaulin is disposed. The cover is usually tensioned over the canopy frame, and the frame is usually formed by a plurality of interconnected elongated tubular members which define the size and configuration of the shelter desired.

Canopies used as shelters for automobiles, boats, and recreational vehicles are often required to be of considerable length, such as 25 feet or longer, while canopies used with sheltered items of lesser dimension, such as a picnic table, require a framework considerably smaller than the aforementioned. Typically, canopies are constructed and fabricated in a custom manner to accommodate a particular use and installation, and once the canopy frame is assembled or fabricated its significant size renders the canopy impractical to move or seasonally store. Hence, canopies of conventional construction are not usually considered to be "portable", and under normal conditions canopies are not considered to be "portable" or readily transported or stored.

A need exists for an all-purpose canopy construction which is economical to manufacture, versatile, readily erected and disassembled, and capable of ease of storage and transport.

OBJECTS OF THE INVENTION

It is an object of the invention to provide an all-purpose canopy having a roof framework which consists of a plurality of modular sections wherein standard canopy sections may be utilized to selectively assemble canopy shelters of a wide variety of lengths by using standard canopy sections.

Another object of the invention is to provide an all-purpose canopy system utilizing modular sections to permit versatile assembly of a variety of sizes and to permit ease of transport and storage rendering the canopy system "portable" to permit relocation and reuse, providing the canopy system with significant resale value.

A further object of the invention is to provide an all-purpose canopy formed of modular sections adapted to be interconnected to provide a pre-determined canopy size wherein the sections are formed of tubular elements welded to each other to define a rigid and high strength assembly.

Another object of the invention is to provide an all-purpose canopy system wherein the canopy roof section is supported upon vertical columns, and the roof sections include transversely disposed brace elements, the columns being adjustably attached to the brace elements facilitating alignment of the columns with the canopy components, and permitting the width spacing of the columns to be less than the canopy shelter width, if desired, and it is also possible to adjust the lengthwise spacing of the columns.

Yet a further object of the invention is to provide an all-purpose canopy system consisting of interconnectable modular sections which may be covered by a flexible cover or tarpaulin and wherein lace fittings are defined on the canopy sections and cover to permit the cover to be uniformly tensioned over the canopy sections to provide an attractive and substantially wrinkle free installation.

An additional object of the invention is to provide an all-purpose canopy system wherein a flexible cover is mounted upon the canopy frame and the cover includes a downwardly extending skirt, the canopy including skirt stabilizers extending downwardly from the corners of the canopy to maintain the skirt properly oriented and prevent skirt disorientation even under windy conditions.

Another object of the invention is to provide an all-purpose modular canopy system which may be assembled and erected by installers of conventional knowledge and mechanical skills with minimal tooling, and the canopy construction permits a variety of uses in diverse applications.

SUMMARY OF THE INVENTION

An all-purpose canopy in accord with the invention basically includes a frame supported on vertical columns and a flexible cover material such as a tarpaulin or the like is stretched over the frame.

The canopy frame is formed by interconnectable modular sections, each section being fabricated of tubular lateral, end, gable and rib elements which are welded together to define an integral unit. The parallel lateral elements define the width of a section, the end elements define the ends of end sections, the gable or ridge element is centrally located between the lateral elements above the plane thereof, and a plurality of rib elements have flattened ends which are welded to the lateral elements and central regions which extend over the gable element and are welded thereto. The free ends of the lateral and gable elements of the respective sections are interconnectable whereby the canopy frame sections may be interconnected to form a complete canopy frame.

The all-purpose canopy frame may consist of two end elements interconnected which will define a canopy of minimum length. If it is desired that the canopy have a greater length than the minimum, modular central frame sections are located between the end sections and connected thereto to increase the length of the frame. One, two or more central frame sections may be interconnected between the end sections to provide a custom canopy length as long as desired.

Brace elements are transversely interposed between the frame lateral elements lying within the plane containing the lateral elements, and the brace elements are provided with end fittings for attachment to the lateral elements and the brace elements are usually spaced along the canopy length at those locations corresponding to the locations of canopy supporting columns. The supporting columns are provided with fittings at their upper ends which encircle the brace element and as the column upper end fitting is transversely adjustably positionable upon the brace element assembly between the column and brace element is expedited reducing the necessity for close installation tolerances between the columns and canopy frame. Preferably, bracing arms are interposed between the columns and the frame lateral edges. The frame support columns are utilized in pairs, and the number of columns employed depends upon the particular installation and the degree of canopy support desired.

The tarpaulin mounted upon the frame includes an edge having lacing grommets formed therein, and a plurality of lacing receiving open end hooks are attached to the underside of the rib elements. Accordingly, the frame mounted open end lacing hooks permit lacing to be threaded around the open end hooks and through the cover grommets permitting an even tension to be applied to the cover which passes around and under the lateral and end elements simplifying the fitting of the cover to the frame in a taut and wrinkle free manner. The use of hooks and grommets also facilitates and simplifies removal and reinstallation of the cover.

In those occasions where it is desired that a skirt be attached to the cover adjacent the periphery of the frame so as to extend downwardly therefrom cover stabilizers are preferably employed at the corners of the frame having a length less than the length of the skirt and received within the skirt internal corners. The skirt corner stabilizers are adjustably attached to either a lateral or end element, or both, and may be angularly oriented to the vertical to maintain a tension within the skirt to prevent the skirt from blowing upwardly or becoming disoriented under high wind conditions.

The fittings used with the all-purpose canopy between the various components include collars for encircling the cylindrical elements permitting the fittings to be readily adjustably located upon the associated elements, and the association of the columns with the brace elements permits the columns to be inwardly located with respect to the side elements to create an overhang of the frame with respect to the columns, if desired. Button detent fasteners or nuts and bolts may be used with the free ends of the frame sections to interconnect the sections and the mode of assembly and disassembly of the canopy permits the canopy to be readily assembled or disassembled by relatively unskilled persons and the canopy may be readily disassembled and stored for the season, or readily transported. The concepts of the invention provide simplicity, a versatility, lower cost, portability and appearance not previously achieved with lightweight canopies presently available.

BRIEF DESCRIPTION OF THE DRAWINGS

The aforementioned objects and advantages of the invention will be appreciated from the following description and accompanying drawings wherein:

FIG. 5 is a top perspective view of a three section all-purpose canopy in accord with the invention as assembled and mounted upon four columns, the cover being omitted for purpose of illustration.

DESCRIPTION OF THE PREFERRED EMBODIMENTS

Figure 1:
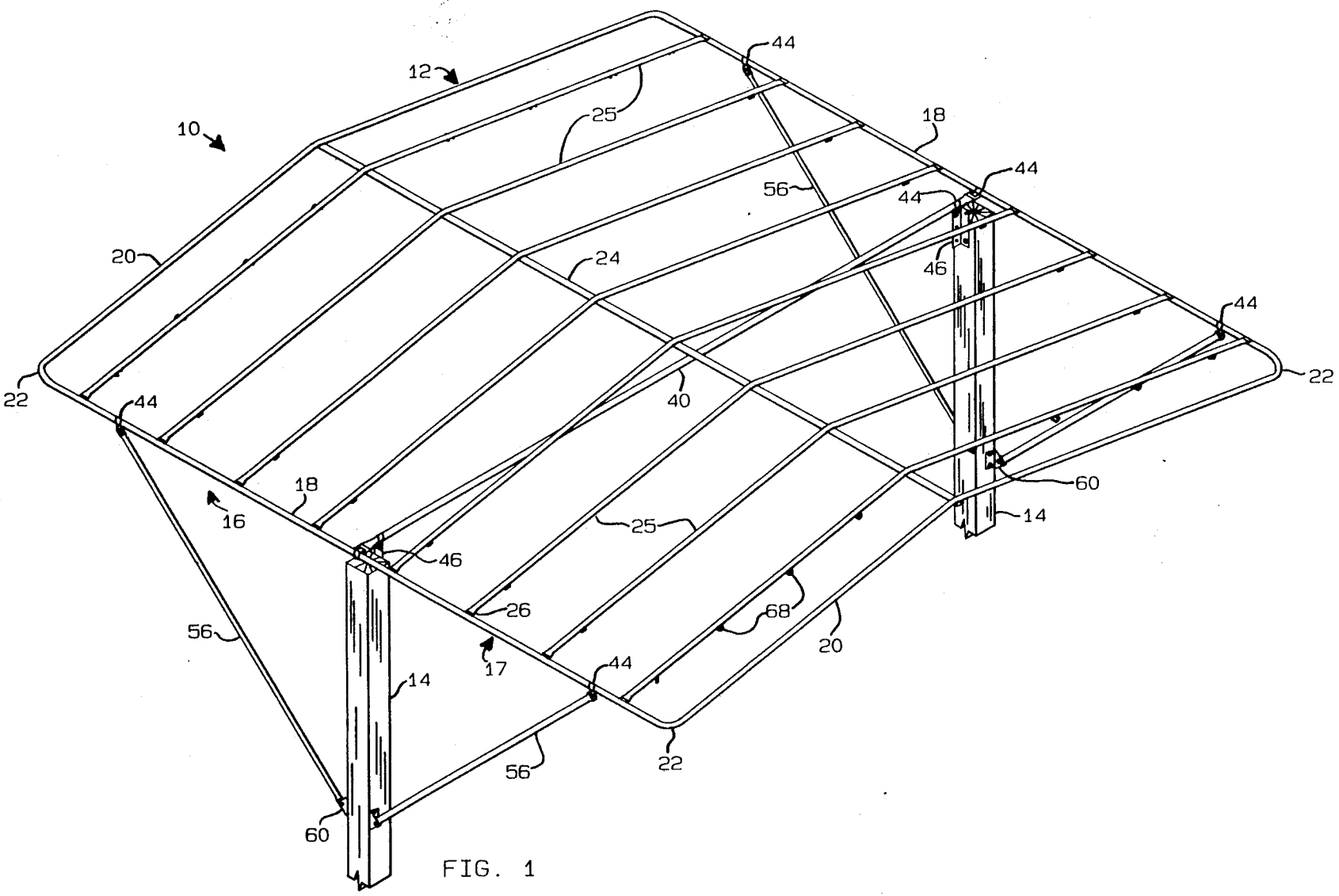
FIG. 1 is a top perspective view of a two section all-purpose canopy in accord with invention, the cover being omitted for purpose of illustration.

An all-purpose canopy constructed in accord with the inventive concepts is generally indicated at 10 in FIG. 1. Basically, the canopy 10 includes a gabled frame 12 supported upon a pair of columns 14. As will be later described, a cover, not shown in FIG. 1 and many of the other figures in order to better illustrate the frame construction, is stretched over the frame, and the frame produces a shelter which may be used with vehicles, boats, benches and the like for protection from the elements.

The frame 12 is formed of a pair of end sections 16 and 17 which are similar in construction, and may be designated right hand and left hand sections. The sections 16 and 17 are formed of a plurality of thin wall steel tubes assuring a strong, yet lightweight, construction.

Each of the sections 16 and 17 includes lateral tubular elements 18. The lateral elements 18 of a common frame section are spaced from each other in parallel relationship and lie in a common plane.

The end sections 16 and 17 include end elements 20 which define the longitudinal length of the frame 12, and the end elements 20 are formed by L-shaped extensions of the lateral elements 18. The end elements include ends 21 which are interconnected by swaging one end of an element 18 and inserting the swaged end into the other element 18 end and then welding the parts together through pre-drilled holes and the intersection of the lateral elements 18 and the end elements 20 results in radiused corners 22 as defined upon the frame 12.

Each of the sections 16 and 17 includes a tubular gable element 24 which is parallel to the lateral elements 18 and is centrally located therebetween. However, the gable element 24 is located above the plane of the lateral elements so as to define a gable for the frame 12. It is to be noted that the end elements 20 at their central regions extend upwardly to the gable element 24 and are welded thereto.

Figure 19:
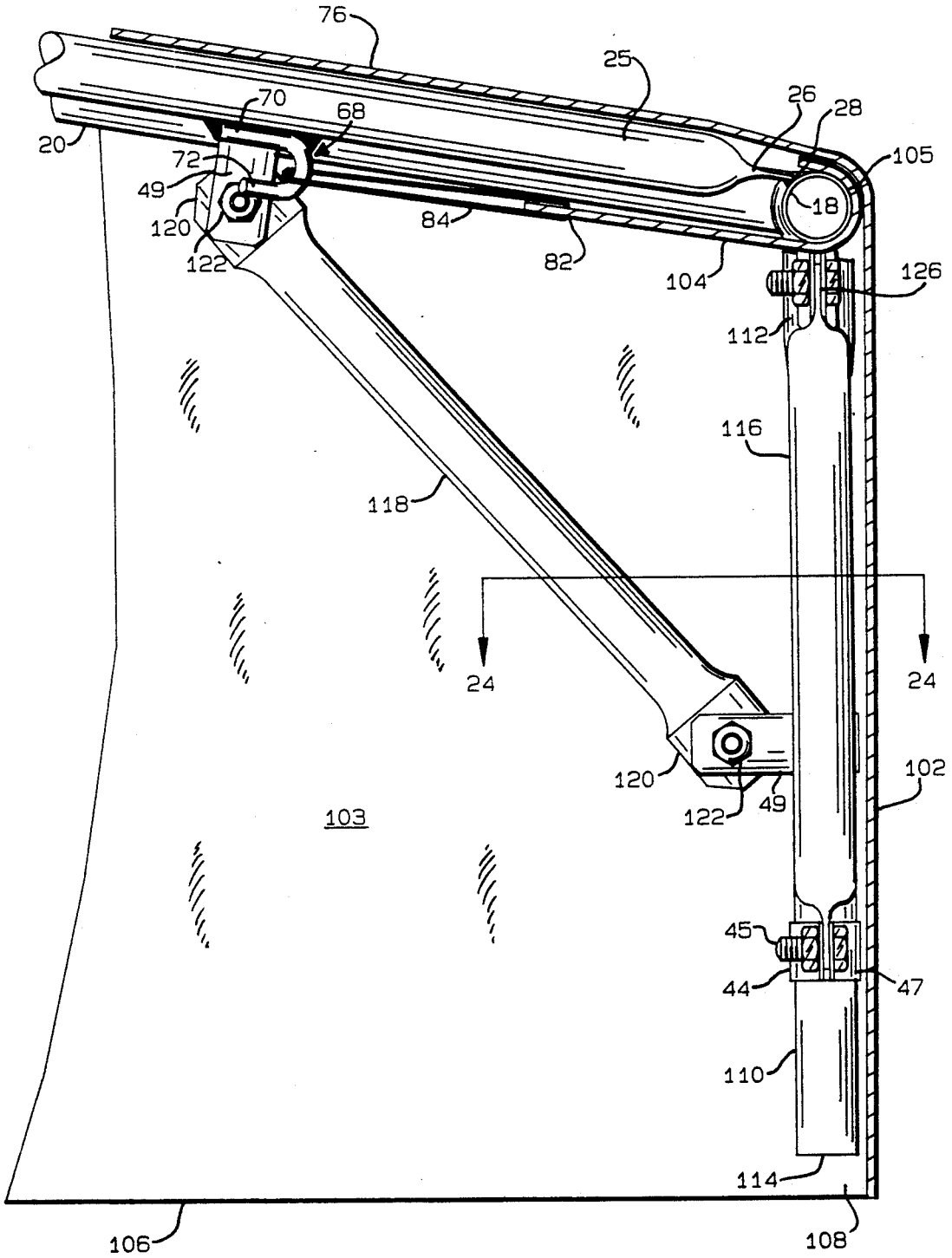
FIG. 19 is an enlarged detail elevational view illustrating the skirt stabilizer and cover lacing components as used with a cover having a skirt.

A plurality of angled rib elements 25 are interposed between the lateral elements 18 of a common section and the elements 25 engage the gable element 24 at their center, and the ends of the rib elements 25 are flattened at 26, as apparent in FIG. 19, and the flattened ends 26 are welded at 28 to the lateral elements 18.

To provide sufficient strength within the canopy 10, and yet assure light weight, the steel tubing constituting the lateral edges 18 and the end edges 20 is of a 1.160 inch outer diameter having a 0.060 inch wall thickness, while the rib elements 25 and the gable element 24 have an outside diameter of 0.927 inches and a wall thickness of 0.045 inches. By welding the center regions of the rib elements to the gable element 24, and welding the rib element ends 26 to the lateral elements 18, each of the sections 16 and 17 comprises a rigid unitary assembly. It will also be appreciated that the tubing of elements 18, 24 and 25 could be rectangular, square or formed of aluminum.

Figure 4:
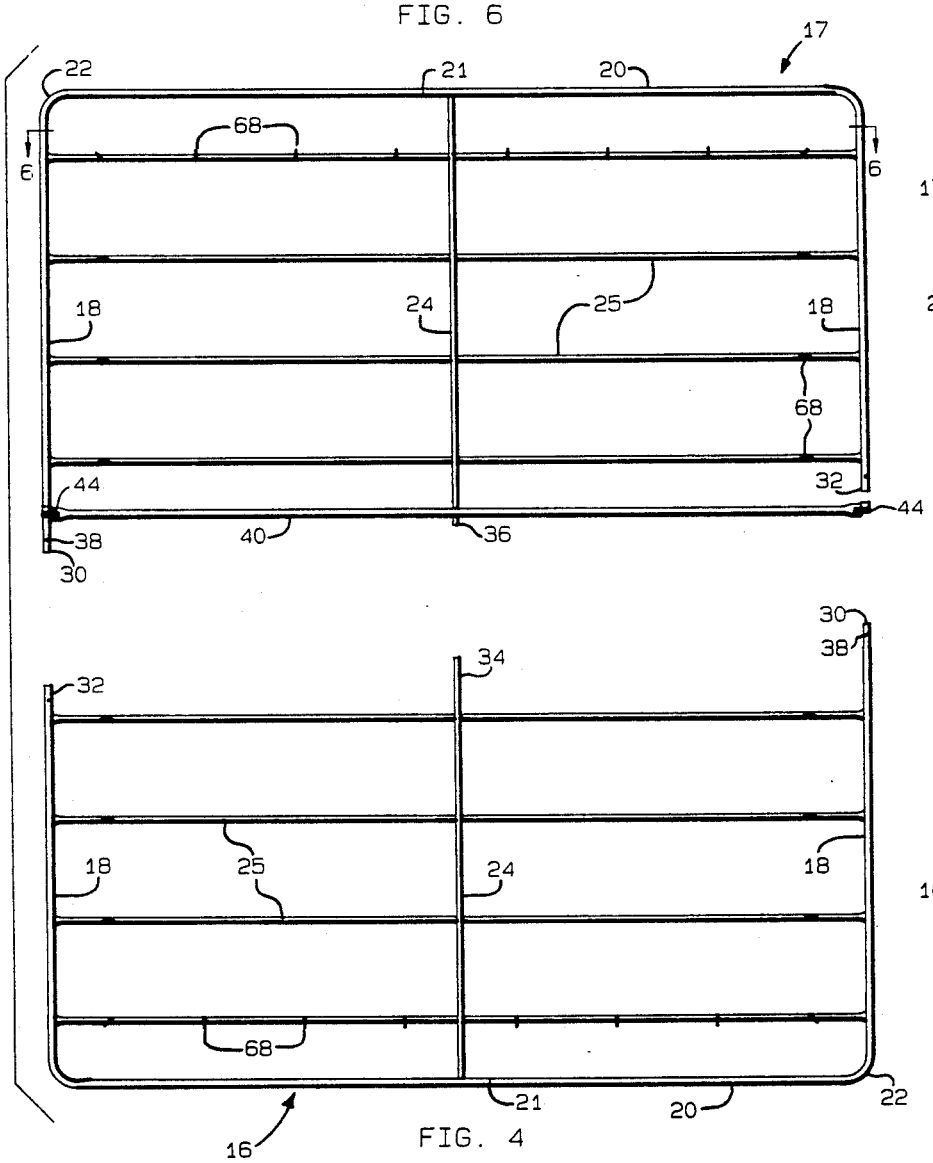
FIG. 4 is a bottom view of the two end sections of a two section canopy frame as shown in an aligned and disconnected relationship prior to assembly.
Figure 5:
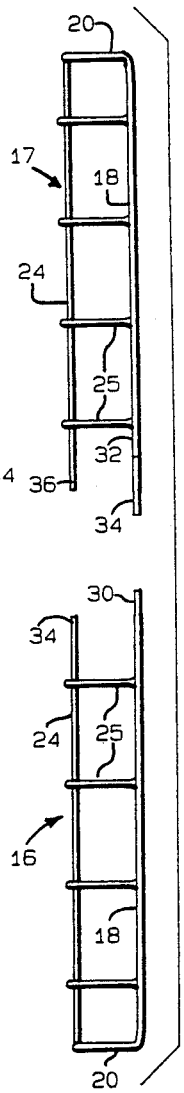
FIG. 5 is a side view of the disassembled two section frame of FIG. 4.

With reference to FIGS. 4 and 5, it will be noted that each of the frame section lateral elements 18 includes a reduced diameter end 30 which has been swaged or drawn to a lesser diameter than the normal diameter of the associated element to form a socket insert. The other free end of the associated section lateral element 18 comprises a female socket end 32 which is of the normal diameter of the element 18 adapted to receive the end 30 in a telescoping manner. Likewise, the free end 36 of the gable element 24 of section 17 is reduced in diameter so as to be received within the normal diameter end 34 of the gable element 24 of frame section 16.

As will be noted from FIGS. 4 and 5 the lengths of the aligned lateral elements 18 of the sections 16 and 17 differ. For instance, with reference to FIG. 4, the length of the right lateral element 18 of section 17 is shorter than the length of the right lateral element 18 of the section 16. Conversely, the length of the left lateral element 18 of section 16 is shorter than the left lateral element 18 of section 17. However, the length of the gable elements 24 of each frame section 16 and 17 are substantially equal and the dimensional relationships described above permit the frame sections 16 and 17 to be assembled by inserting the lateral element ends 30 into the lateral element ends 32, and the gable element end 36 into the gable element end 34. Button detent fasteners 38 of known construction are located within the lateral element ends 30 for cooperating with holes defined in the lateral elements adjacent the ends 32, or nuts and bolts may be used, and in this manner once the sections 16 and 17 are assembled as described above an interconnected frame 12 as shown in FIG. 2 will result.

By using different lengths of the lateral elements 18 the "joint" interconnecting the sections 16 and 17 will not be perpendicular to the length of the assembled frame 12 and increases the strength of the assembled sections and improves the relationship and mechanical characteristics of the brace element used with the frame 12 as described below.

Figure 13:
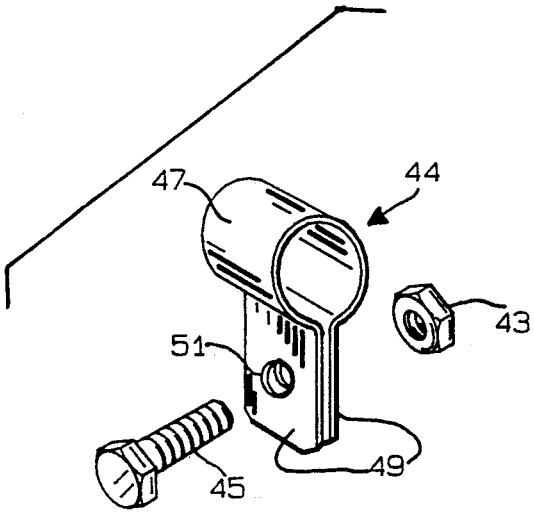
FIG. 13 is a perspective view of a typical element embracing fitting as used to assemble and interconnect many of the canopy components.

Upon the sections 16 and 17 being assembled a tubular brace element 40 is interposed between the sections, lateral elements 18 for strengthening the frame widthwise. The brace element 40 is formed of the same dimension steel tubing as the lateral elements 18 and is provided with flattened ends 42, FIGS. 25 and 26, having holes formed therein. The ends 42 are attached to connectors 44 such as shown in FIG. 13 which include a collar 47 and ears 49. The ears 49 of the connector 44 are located upon opposite sides of the brace element flattened end 42 and a bolt 45 extending through aligned holes 51 in the ears 49 in association with nut 43 attaches the fitting 44 to the end of the brace element upon the connector collar 47 encircling the adjacent lateral element 18. Tightening of the bolt 45 and nut 43 simultaneously mounts the connector 44 upon the brace element 40 and the connector upon the lateral element 18.

Figure 11:
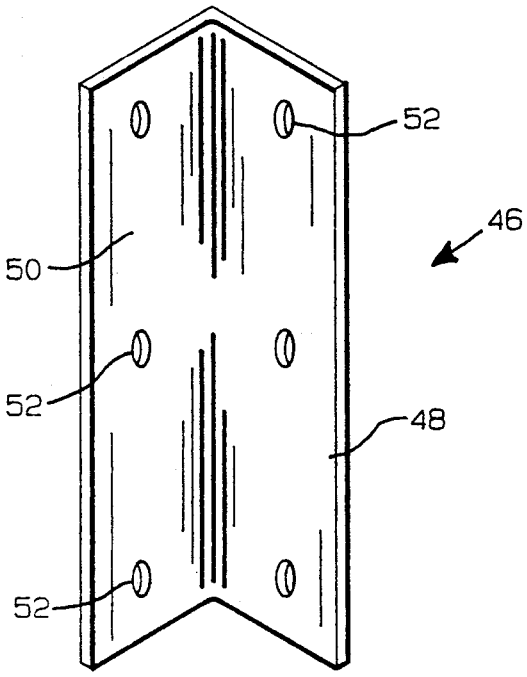
FIG. 11 is an enlarged perspective view of a column top angle mounting, fitting.
Figure 15:
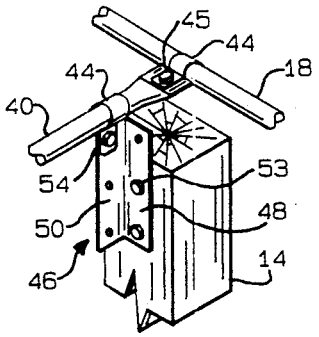
FIG. 15 is a detail perspective view illustrating the components as mounted upon the top of a wood column as supporting the canopy frame.

The frame 12 may be connected to the columns 14 through the brace element 40 by an angle fitting 46 shown in FIG. 11. The angle fitting 46 includes a flat column attachment portion 48 and a fitting portion 50 disposed at 90° to the column portion 48. Holes 52 are defined in the portions 48 and 50 and upon locating the column portion 48 against the column 14, as shown in FIG. 15, screws 53 extending through the holes 52 will connect the fitting 46 to the associated column 14 adjacent the column upper end wherein the column 14 is of the wood rectangular type. A bolt 54 extending through the upper hole 52 defined in the fitting portion 50 extends through the hole 51 of the ears 49 of a connector 44 whose collar 47 encircles the brace element 40 and in this manner the brace element, and frame 12, are connected to the upper ends of the columns 14.

It is to be understood that the connectors 44 are used in a number of locations with the canopy 10 and while the diameter of collar 47 may vary to accommodate the size of the encircled component the structure of all connectors 44 is identical and numeral 44 is used to designate this type of connector regardless of size and unless otherwise indicated a bolt 45 and nut 43 are used to clamp the ears 49.

Figure 12:
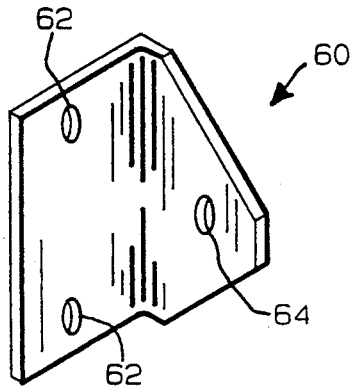
FIG. 12 is a perspective view of another version of a column angle mounting fitting as used with brace arms.
Figure 16:
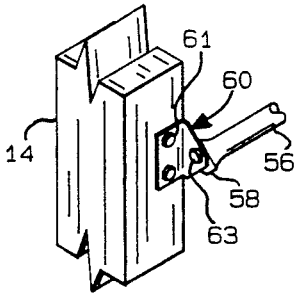
FIG. 16 is a detail perspective view of the lower brace arm fitting as attached to a wood column.

For stability, a tubular brace arm 56 is located upon each side of a column 14 having flat ends 58, FIG. 16, and the lower ends of the brace arms 56 are connected to the angle fittings 60, FIG. 12, which are mounted upon the columns 14 at a point substantially lower than the column upper end. The fitting 60 includes holes 62 for attaching the fitting to the column by screws 61, and the fitting hole 64 permits a bolt 63 to pivotally attach the lower end of the arm 56 to the fitting 60. At its upper end, the brace flat end 58 is attached to the adjacent lateral element 18 by a connector 44 and bolt 65 in a manner which will be apparent from FIG. 17.

The aforedescribed manner of connecting the frame 12 to the columns 14 has several significant advantages. First, while the brace element 40 is centrally located between the frame end elements 20 as will be appreciated from FIG. 2, the difference in lengths of the lateral elements 18 of the sections 16 and 17 permits the brace element to be attached to the lateral elements at a location other than directly upon the joint lines of the lateral elements as will be appreciated from FIG. 2. Thus, the brace element 40 is firmly connected to the frame 12 at a central location so that the primary weight of the frame 12 may be imposed upon the brace element. By mounting the upper end of the columns 14 to the brace element 40 it is not necessary for the spacing between the two columns 14 to be accurately maintained, as would be the case if the upper ends of the columns 14 were connected to the lateral elements 18. Differences in dimension between the separation of the columns 14 and the spacing of the lateral elements 18 can be readily accommodated by sliding the connectors 44 mounted upon the fittings 46 along the associated brace element 40 prior to tightening the bolts 54, FIG. 15.

Figure 17:
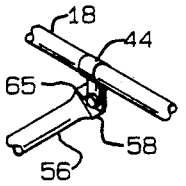
FIG. 17 is a detail perspective view of the upper brace arm fitting as attached to a frame lateral element.
Figure 31:
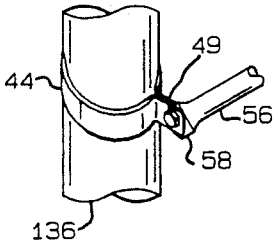
FIG. 31 is an enlarged detail perspective view of the brace arm lower end fitting as used with a cylindrical metal column.

The brace arms 56 provide stability of the frame 12 on the columns 14 and the braces may be quickly adjusted relative to the frame to maintain the frame in a horizontal orientation merely by sliding the brace upper end connectors 44 along the associated lateral elements 18 prior to tightening the connector bolts 65 associated with the ears of the connector, FIG. 17.

Figure 2:
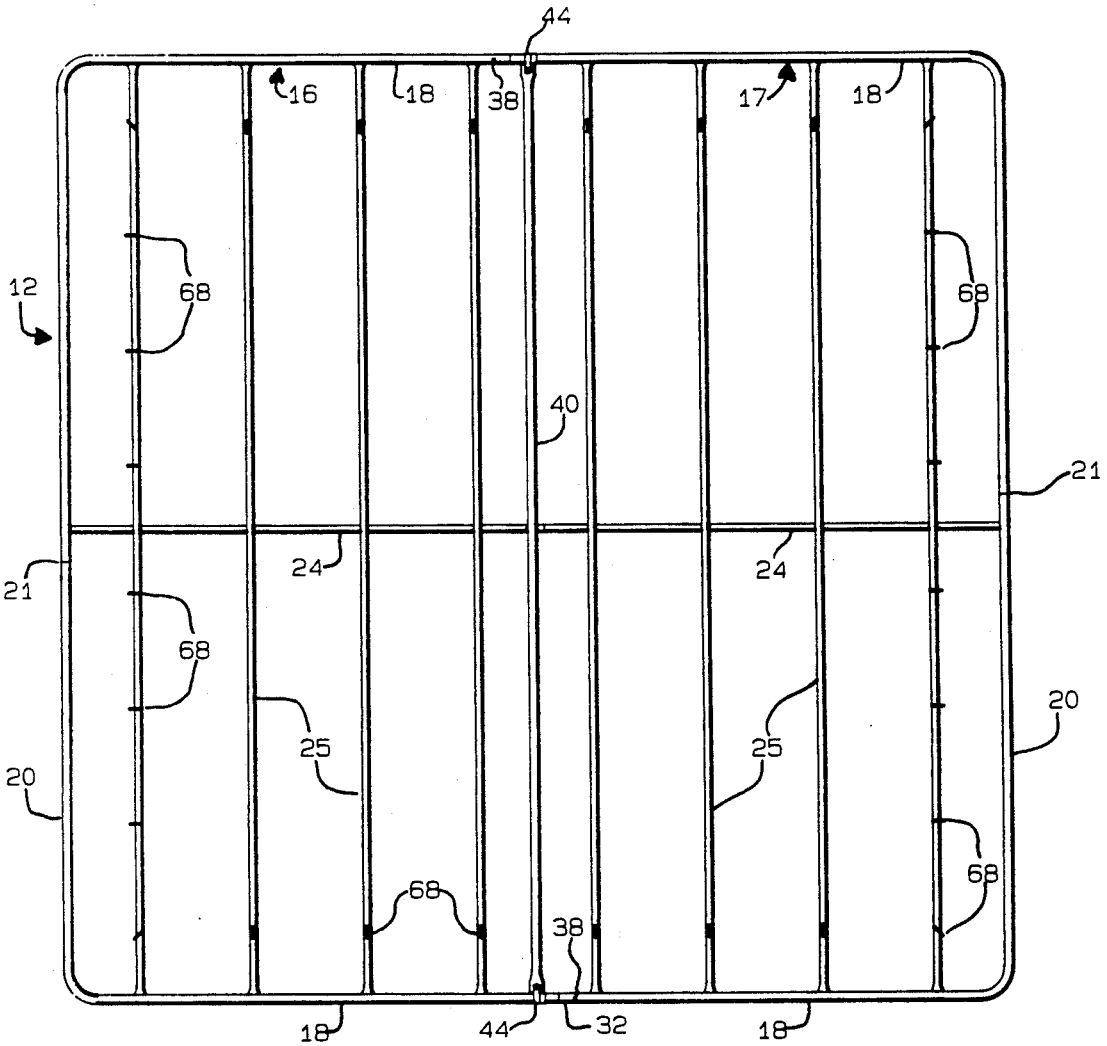
FIG. 2 is an underside bottom view of a two section canopy frame as assembled with a brace element in position.
Figure 3:
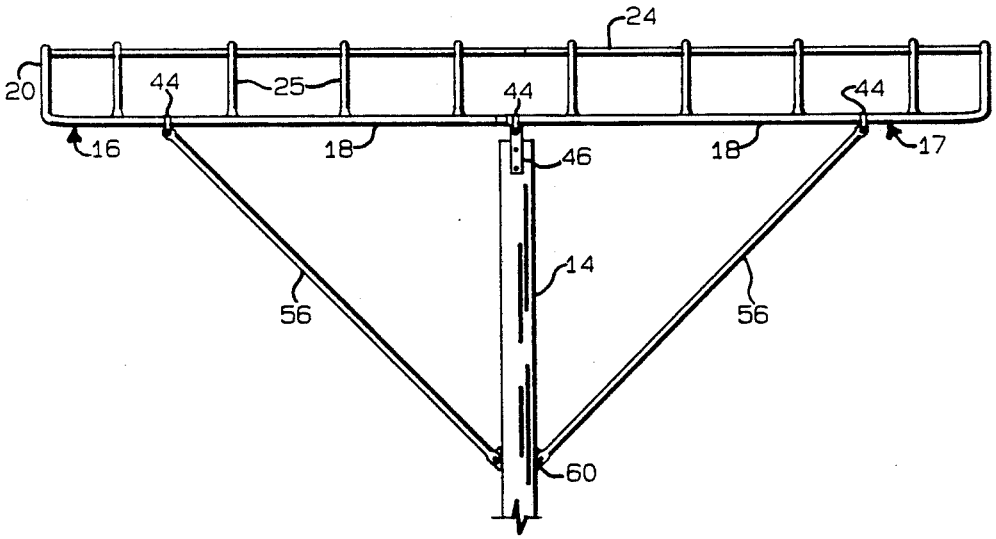
FIG. 3 is a side elevational view of the two canopy section in accord with the invention.
Figure 6:
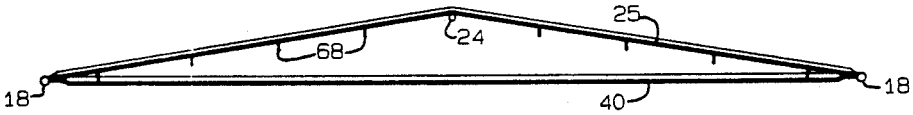
FIG. 6 is an end elevational sectional view as taken along Section 6—6 of FIG. 4.
Figure 14:
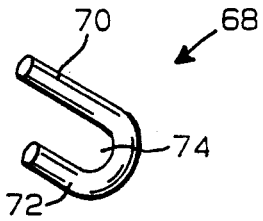
FIG. 14 is a perspective view of an open end lacing hook, per se, of the type welded to canopy elements.

The cover stretched over the frame 12 utilizes a laced interconnection with the frame, and to this end a plurality of hooks 68 are welded to the underside of the rib elements 25 as will be appreciated from FIGS. 2 and 4. The hooks, as shown in FIG. 14, include an end 70 which is welded to the underside of the associated rib element, and the hook includes a free end 72 which extends downwardly defining a loop 74 closed in the direction toward the periphery of the frame 12. The hooks are welded to the rib elements 25 several inches from the rib element ends 26, eight inches in a commercial embodiment, and the rib elements 25 closest to the section end elements 20 each have a plurality of hooks 68 welded thereon as readily appreciated from FIG. 2. The spacing of the rib elements closest to the end elements 20 is substantially equal to the distance of the location of the hooks 68 on the other rib elements 25 from the rib element ends 26, and the spacing of the hooks 68 on a common rib element adjacent the end elements is equal to the spacing of adjacent rib elements 25 from each other. Thus, the location of the hooks 68 is uniform with respect to the periphery of the canopy frame 12.

Figure 18:
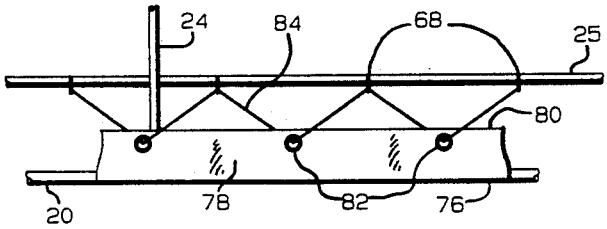
FIG. 18 is an underside detail view illustrating the lacing of a flexible covering not having a skirt showing the lacing hooks mounted upon a rib element adjacent a canopy end element.

The canopy frame cover 76 may be formed of canvas, vinyl, synthetic plastic, or the like, and the particular material of the cover 76 does not form a part of the instant invention. The cover 76 will include a peripheral region 78, FIG. 18, which, when the cover is superimposed over the gabled frame 12 the peripheral portion 78 will pass around and under the lateral elements 18 and the end elements 20. The cover is provided with an edge 80, and grommets 82 are located within the cover adjacent the edge 80. The spacing between the grommets 82 corresponds to the spacing between adjacent rib elements 25, and a lacing cord alternately threaded through grommets 82 and hook loops 74, FIG. 18, permits the cover 76 to be uniformly tensioned over the frame 12 to provide an attractive water impervious barrier. The use of the hooks 68 permits the lacing operation to be quickly performed and the ability of the lacing to slip through the grommets and hooks permits uniform tensioning of the cover for the elimination of wrinkles and folds. The open end hooks 68 also allow the lacing to be quickly removed from the hooks while the lacing remains threaded through the grommets permitting the cover 76 to be easily removed from the canopy frame 12, and installed thereon, between seasons.

In a commercial version of the invention the width of the canopy 10 as defined by the spacing of the lateral elements 18 is approximately ten feet which permits most vehicles and boats to be accommodated thereunder. Preferably, the length of the frame end sections 16 and 17 is approximately five feet whereby disassembled sections of five foot by ten foot may be readily manually handled during assembly and disassembly, and during storage and transporting. As the canopy 10 of the invention is often used in conjunction with vehicles and boats having lengths greater than ten feet the canopy embodiment shown in FIGS. 1–6 is of insufficient length, and with the practice of the invention it is possible to custom assemble canopies of a ten foot width and of a length of forty feet or greater.

The length of the canopy frame may be readily increased by installing frame sections intermediate the end sections 16 and 17. Such an extended length frame is illustrated in FIGS. 7–10 wherein a three section frame is illustrated which would have an overall length of approximately fifteen feet.

With reference to FIGS. 7–10 components identical to those previously described are indicated by identical reference numerals and, being identical to aforedescribed structure require no explanation.

Figures 8, 9, 10:
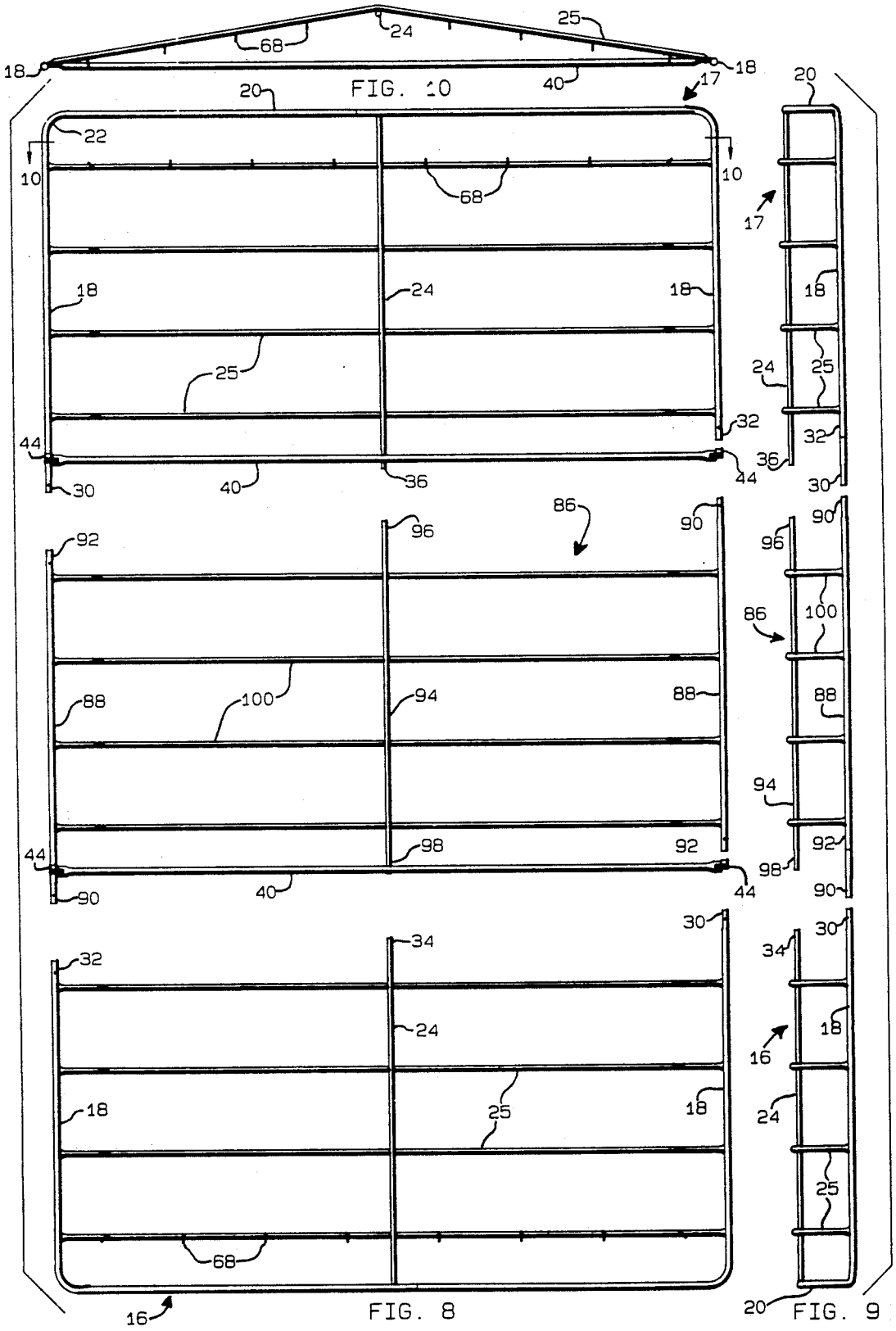
FIG. 8 is an underside exploded view of a three section canopy frame in accord with the invention, the sections being aligned, but not interconnected, and two brace elements being illustrated.
FIG. 9 is a side elevational view of the three section canopy, disassembled, of FIG. 8.
FIG. 10 is a sectional elevational view of a canopy section as taken along Section 10—10 of FIG. 8.

With reference to FIG. 8, a center frame section 86 is illustrated which consists of parallel spaced lateral elements 88 lying in a common plane and each lateral element includes a male socket insert end 90 of reduced dimension capable of being telescopically received within a socket end 32 of a frame end section and a female end 92 which receives an end 30 of each frame end section. The center section 86 also includes a gable element 94 lying above the plane of the lateral elements 88 having a reduced dimension male end 98 insertable into gable element end 34 and a normal diameter female end 96 telescopically receiving the end 36 of an end section gable element 24. A plurality of parallel rib elements 100 identical in form to the rib elements 25 pass over and are welded to the gable element 94 and the ends of the rib elements 100 are flattened and welded to the lateral elements 88 similar to the previous description.

As will be appreciated from FIG. 8, the center frame lateral elements 88 are longitudinally displaced with respect to each other in a manner identical to the longitudinal location of the ends of the lateral elements 18 of sections 16 and 17. A line interconnecting the ends 90 and 92 of lateral elements 88 located at a common end of the section 86 is obliquely oriented to the length of the section and passes through the gable end 96 or 98 located at the same end of the section 86. Such obliquely oriented lines at each end of the sections 86 are parallel, and parallel to similar lines drawn between the ends of the lateral elements 18 of the sections 16 and 17. Thus, the configuration of the section 86 is modular with respect to the sections 16 and 17 and any number of sections 86 can be interconnected to each other and the end sections 16 and 17 to form a canopy frame of the desired length. Button detent fasteners 38 or nuts and bolts are located within the lateral element ends 90 and to produce a canopy of a desired length it is only necessary to align and assemble the number of center sections 86 desired to achieve a predetermined length.

Figure 7:
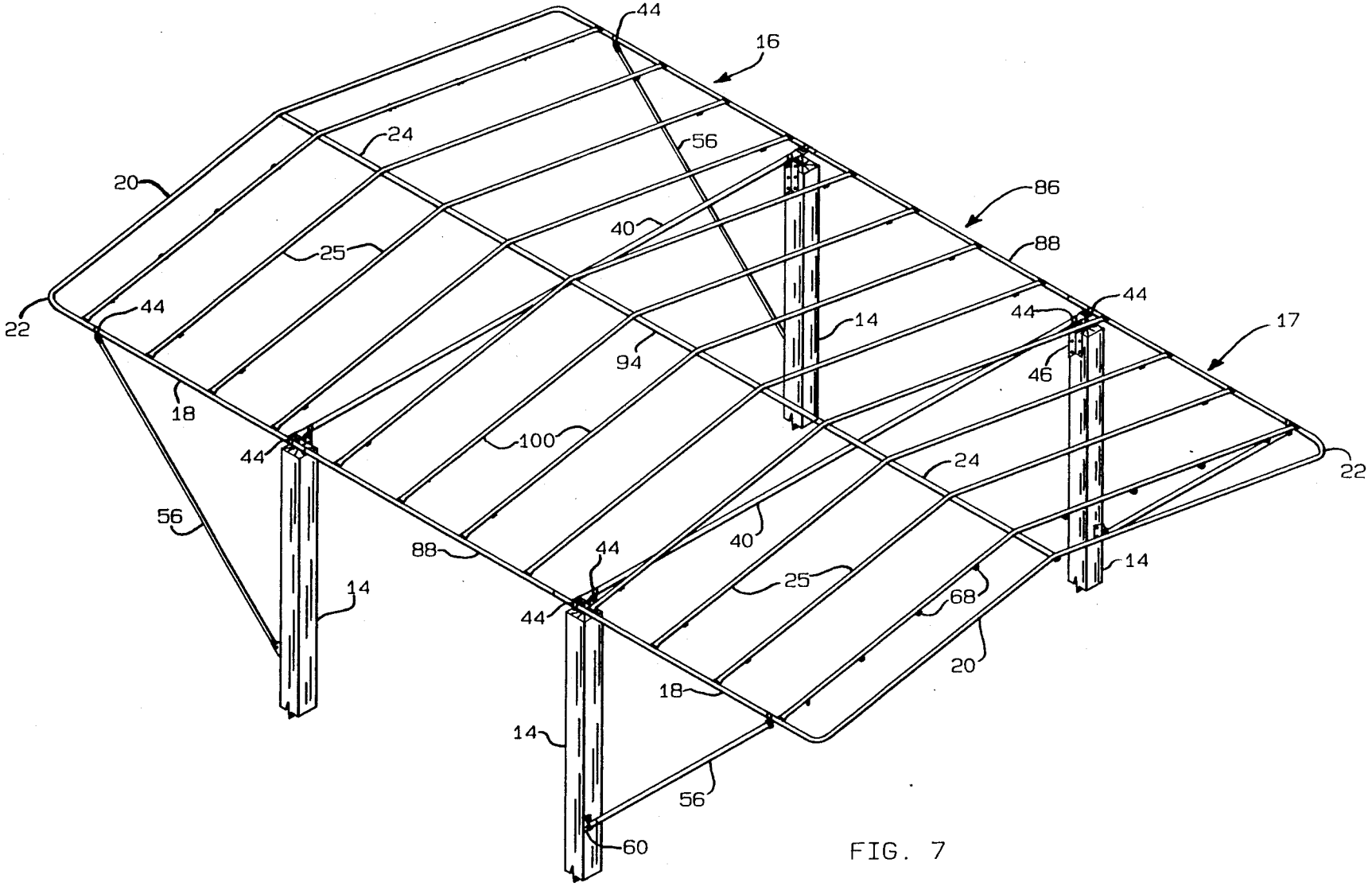

When assembling a canopy frame of three or more sections it is preferred that a brace element 40 be interposed between the lateral elements of the frame adjacent each section interconnection, as explained above with respect to the two section frame 12, and as shown in FIG. 7.

It is desirable, although not absolutely necessary, to locate supporting columns 14 at each frame interconnection, and as illustrated in FIG. 7 the support of the three section frame is upon four columns 14, the upper end of the columns being provided with the hardware shown in FIG. 15 and as previously described. However, it is possible to laterally space the columns 14 up to twelve feet apart and still obtain adequate support. It will be appreciated that in FIG. 7 only one bracing arm 56 is associated with each column as the use of four columns 14 may eliminate the need for the two brace arms per column arrangement shown in FIGS. 1 and 3 with a three section frame. Of course, double bracing of each arm may be desirable with particularly long lengths of canopies such as those shown in FIGS. 27–30, 32 and 33.

For appearance purposes it is often desirable that the cover 76 include a skirt for extending below the canopy frame, and such a skirt includes the side portion 102 and the end portion 103 as shown in FIGS. 19, 21, 24, 27, 28, 29, 30, 32 and 33. The cover skirt 102/103 constitutes an extension of the cover 76 and includes a lower edge 106. When the cover 76 includes a skirt 102 a flap 104 is internally sewn to the cover 76 at 105, FIG. 19, and the grommets 82 are located in the flap 104 for receiving the lacing 84 to permit the cover 76 to be tensioned upon the canopy frame. While a skirt significantly improves the appearance of the canopy, and obscures much of the canopy frame structure from view, the skirt is subjected to displacement by the wind, and the skirt will blow upwardly upon the frame if not restrained. In accord with the invention a novel means is employed to maintain the skirt properly oriented to the frame.

Figure 24:
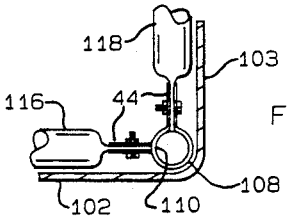
FIG. 24 is a detail plan sectional view as taken along Section 24—24 of FIG. 19 through the stabilizer and skirt internal corner.

That portion of the skirt depending from the frame corners 22 defines a skirt internal corner 108, and a skirt stabilizer 110 is located within the skirt internal corner 108 as shown in FIGS. 19 and 24.

Figure 23:
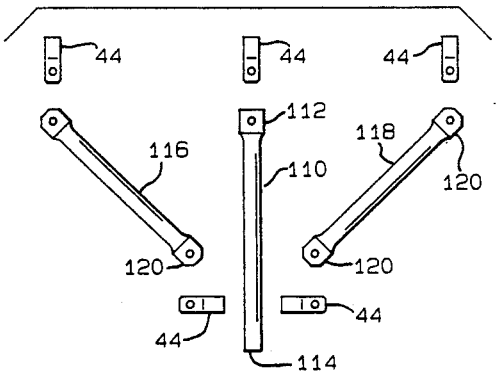
FIG. 23 is an exploded view of the skirt stabilizer and associated components.

The skirt stabilizer 110 consists of a tubular member having an upper flat end 112 and a lower end 114 as shown in FIG. 23. The length of the stabilizer 110 is less than the vertical dimension of the skirt 102/103 whereby the stabilizer lower end 114 does not extend below the skirt lower edge 106.

Figure 22:
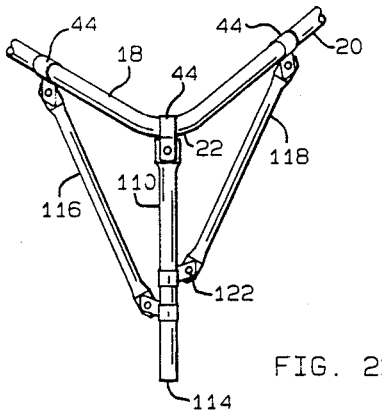
FIG. 22 is a perspective view of the mounted skirt stabilizer illustrating the pair of bracing arms associated with the stabilizer.
Figure 21:
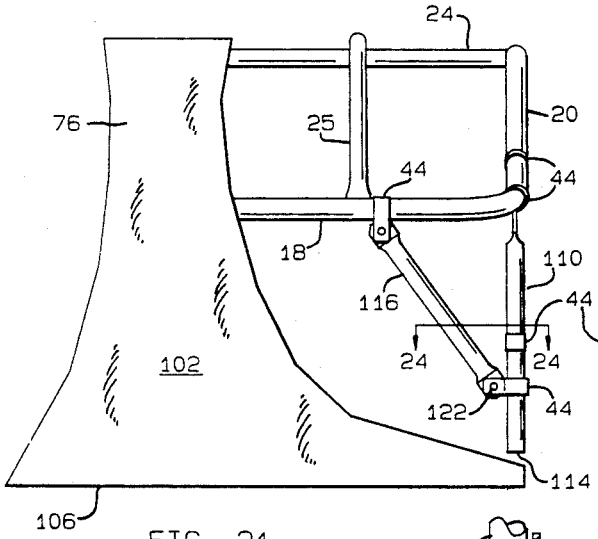
FIG. 21 is a side elevational detail view of the frame, cover, skirt and skirt stabilizer, a portion of the skirt being broken away for purpose of illustration.
Figure 20:
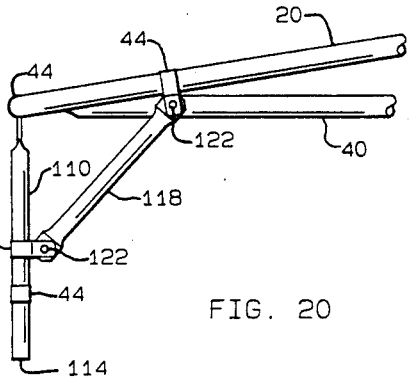
FIG. 20 is a detail elevational end view of the skirt stabilizer prior to the cover and skirt being associated therewith.

The upper flat end 112 of the stabilizer 110 is attached to a canopy frame corner 22 by a connector 44, FIGS. 20, 21 and 22, and a brace arm 116 is interposed between the stabilizer 110 and the adjacent lateral element 18, and a brace arm 118 is interposed between the stabilizer and the adjacent end element 20. The brace arms 116 and 118 are each provided with flat ends 120 whereby connectors 44 and bolts 122 may be associated therewith for slidably locating the connectors 44 on the stabilizer or associated frame element and thereby adjust the angular orientation of the stabilizer 110 to the vertical. Ideally, the dimension of the cover 76 and skirt 102/103 will be such that when the stabilizer 110 is vertical the stabilizer will be snugly received within the associated skirt internal corner 108 maintaining sufficient tension in the skirt to prevent the skirt from blowing upwardly or becoming otherwise displaced from its desired orientation to the cover 76. However, if the dimensions of the skirt 102/103 may slightly depart from the intended dimension, it is possible to angularly orient the stabilizer 110 by adjustment of the braces 116 and 118 to compensate for dimensional tolerances in the skirt and place the skirt under sufficient tension to locate the skirt as desired.

Figure 26:
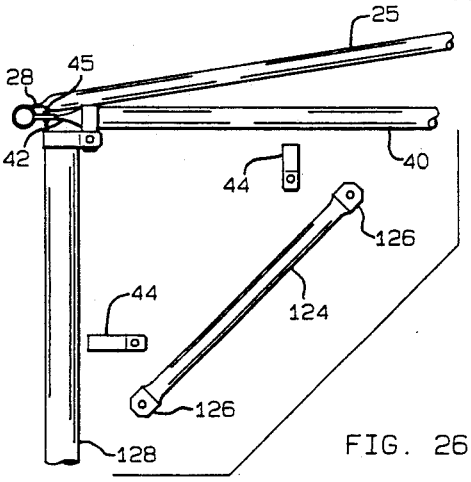
FIG. 26 is an end elevational detail view of a column and canopy frame similar to FIG. 25 illustrating the bracing arm components in an exploded relationship.
Figure 25:
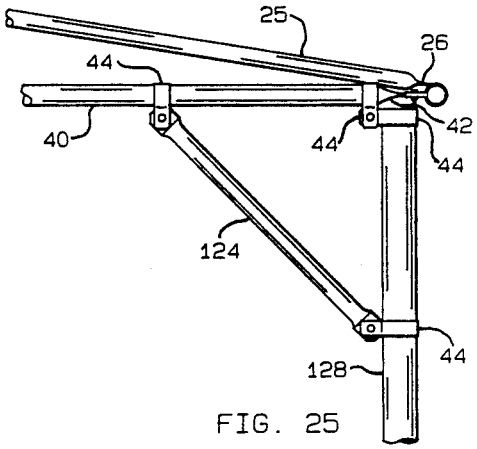
FIG. 25 is an end elevational detail view of an assembled column and canopy section wherein the column is of a cylindrical configuration and a brace arm is used between the column and brace element.

In FIGS. 25 and 26 an arrangement is shown wherein additional bracing may be utilized with the frame transverse brace elements 40 and this extra bracing is usually used when the canopy is employed in marine installations. In this arrangement a brace arm 124 is provided with flat ends 126, and by the use of connectors 44 the upper end of the brace arm 124 may be adjustably positioned upon the associated brace element 40, and the lower end of the brace arm is adjustably connected to the metal cylindrical support column 128 by a larger size connector 44 and bolt. Cylindrical metal support columns 128 are often used with marine installations wherein the canopy 10 functions as a shelter for boats, and the use of a brace arm 124 imparts additional rigidity to the canopy assembly in a transverse direction, and such bracing is particularly desirable with canopies of greater lengths wherein the canopy support columns are located at a greater distance than five feet from each other on a common canopy side.

Figure 27:
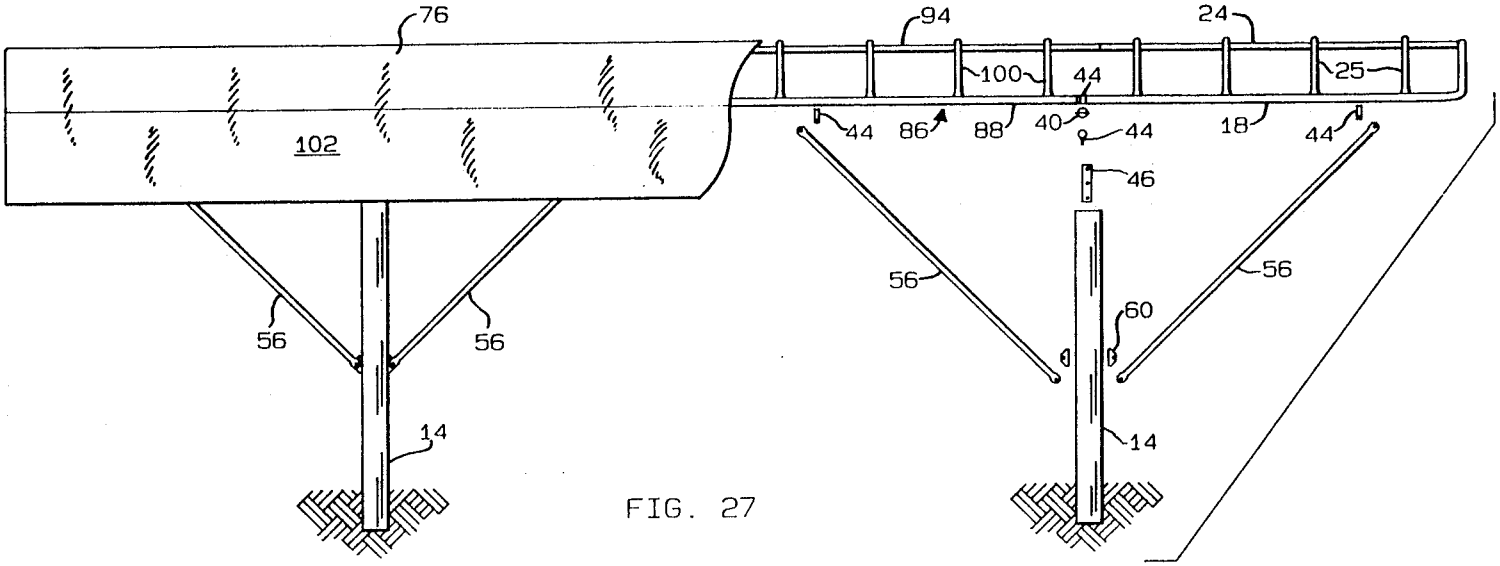
FIG. 27 is a side elevational view, partially sectioned and exploded, illustrating a four section all-purpose canopy as supported upon four columns, two of which are visible.
Figure 28:
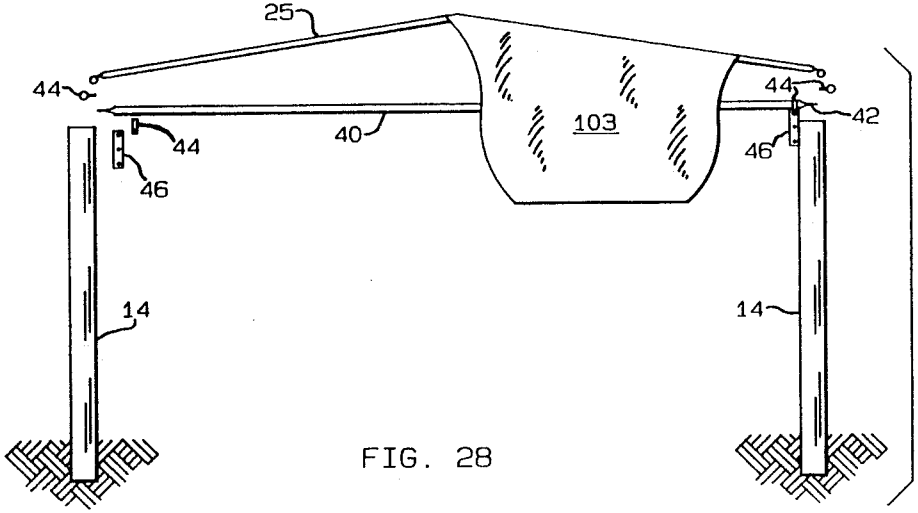
FIG. 28 is an end elevational view, partially sectioned and exploded, of the canopy assembly of FIG. 27.

FIGS. 27 and 28 illustrate a canopy arrangement wherein a plurality of center sections 86 have been installed between the frame end sections and four support columns 14 are used to support a frame of considerable length. In this instance, two brace arms 56 are associated with each column 14, and a skirt stabilizer 110 is not illustrated.

Figure 29:
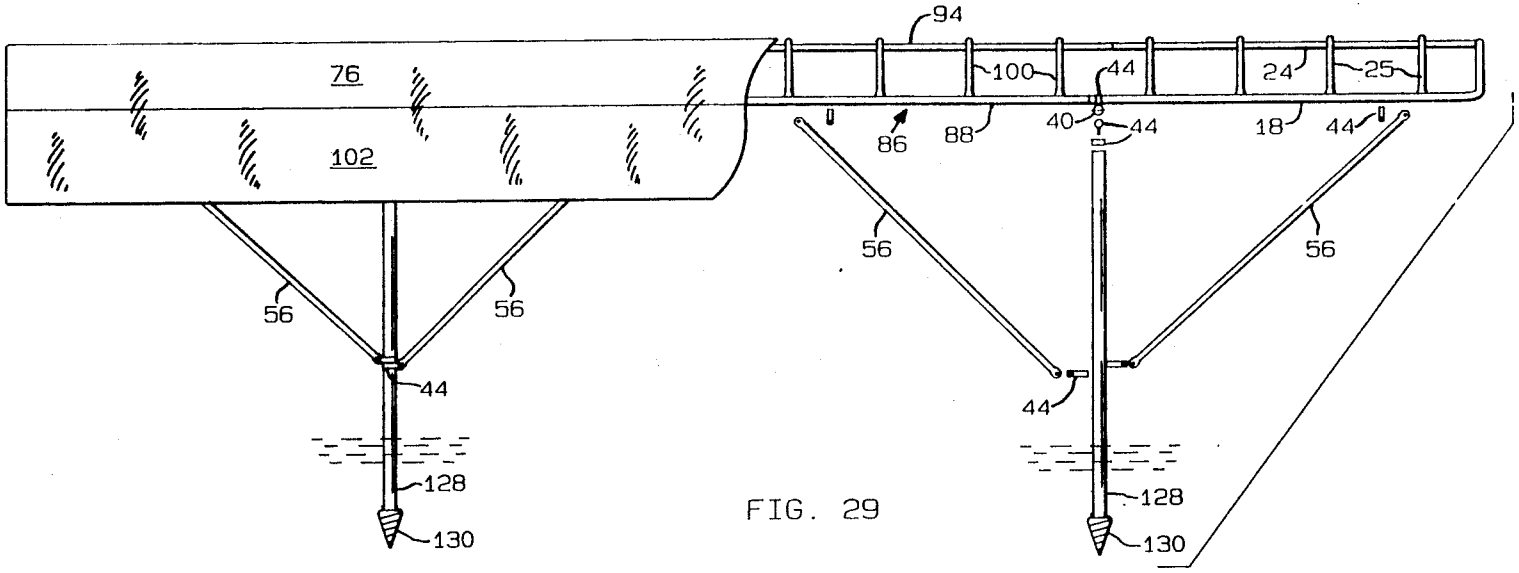
FIG. 29 is a side elevational view, partially sectioned and exploded, illustrating four canopy sections as mounted upon four marine columns, two of which are visible, having auger feet such as used with a boat shelter.
Figure 30:
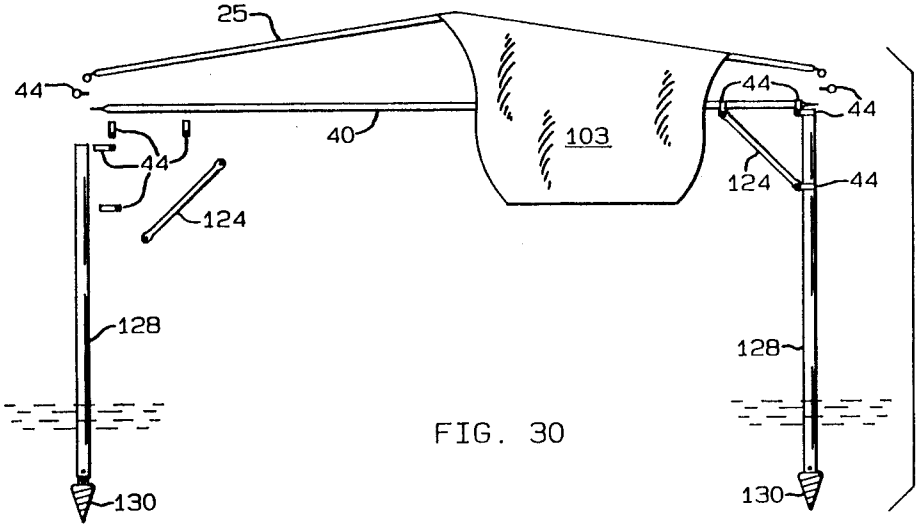
FIG. 30, is an end view, partially sectioned and exploded, of the canopy shelter of FIG. 29.

The canopy illustrated in FIGS. 29 and 30 is particularly suitable for marine use for providing a shelter for boats in that cylindrical metal pipe columns 128 are employed, and an auger foot 130 is located at the lower end of each column 128. When installing a shelter such as shown in FIGS. 29 and 30 the columns 128, prior to being assembled to the canopy frame, are rotated for positioning within the underwater terrain, and after the auger feet sufficiently penetrate said soil the canopy frame may be mounted upon the upper end of the columns in the manner previously described with minimal tooling.

Figure 32:
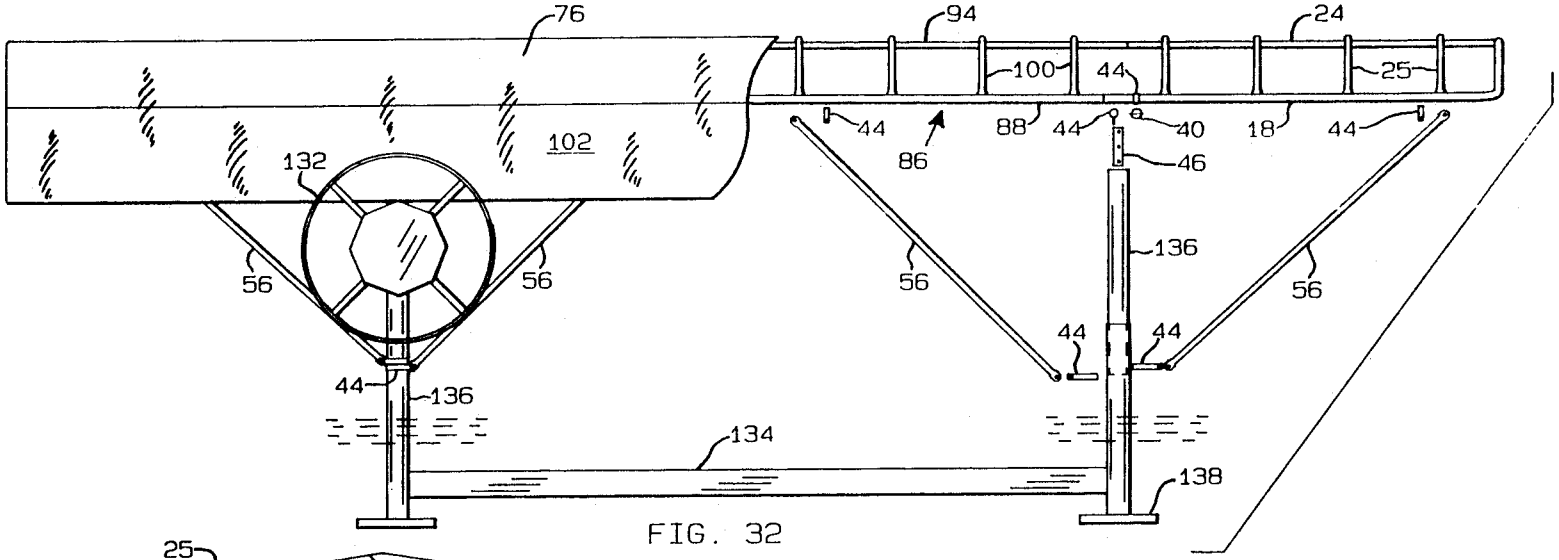
FIG. 32 is a side elevational view of a boat canopy shelter of the elevatable type wherein four canopy sections are employed and the columns rest upon platforms.
Figure 33:
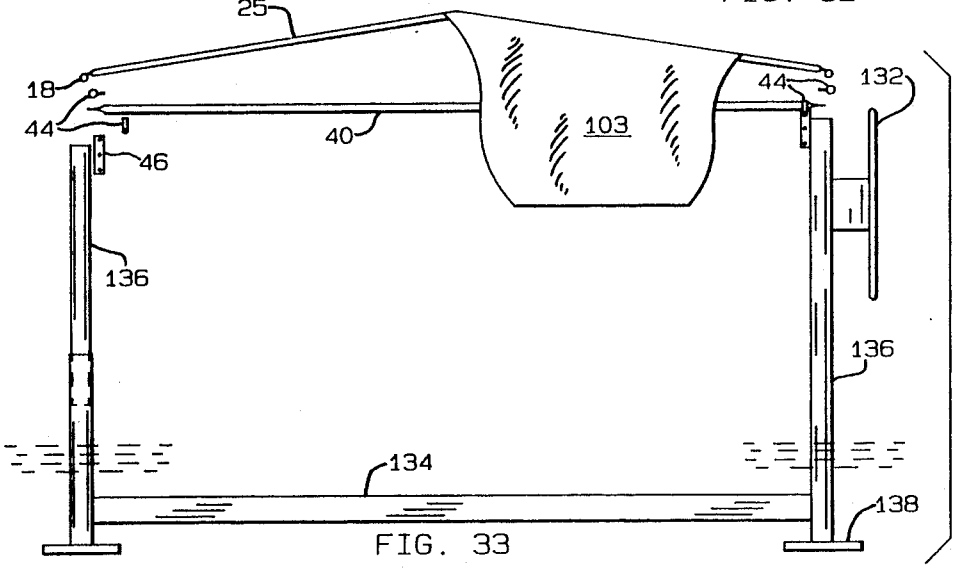
FIG. 33 is an end view, partially sectioned and exploded, of the boat canopy shelter as shown in FIG. 32.

In FIGS. 32 and 33 another marine installation of the canopy of the invention is shown, and in this embodiment the canopy is mounted upon four two-part telescoping columns 136 having plates 138 located at their outer ends whereby the columns will rest upon the water bottom. This type of construction may be used with boat lifts using winch wheels 132 through appropriate structure, not shown and not a part of the invention, to raise the boat from the water and base braces 134 interposed between the columns 136 will provide a rigid substructure for supporting the canopy frame.

Figure 34:
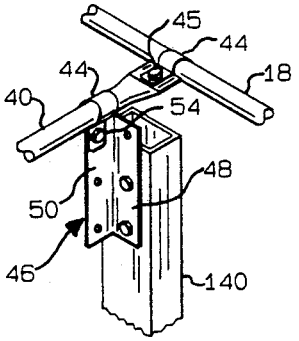
FIG. 34 is a detail perspective view of an angle fitting mounted upon the top of a metal rectangular column as attached to a brace element.
Figure 35:
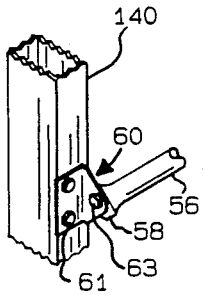
FIG. 35 is a detail perspective view of an angle fitting as used with a brace arm as mounted upon a metal rectangular column.

In the above description several types of columns for supporting the canopy frame 12 have been described, and it is to be appreciated that the canopy structure may be supported on a wide variety of types of columns. For instance, the columns 14 are usually of a wood rectangular type such as commonly available from a lumber yard, and with wood columns the angle fittings 46 and 60 are best employed. However, the columns may also consist of tubular rectangular metal structures such as shown at 140 in FIGS. 34 and 35, and the angle fittings 46 and 60 may be used with such a tubular metal column in the manner which will be apparent from the drawing and the above description since identical fitting components are employed as with a wood column.

Figure 36:
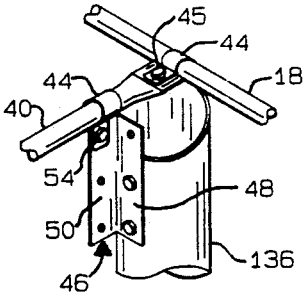
FIG. 36 is a detail perspective view of an angle fitting mounted upon the top of a metal cylindrical column as attached to a brace element.
Figure 37:
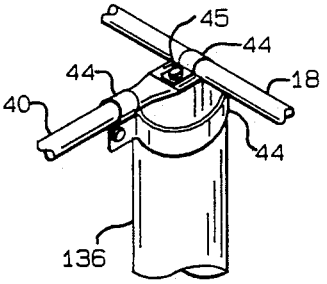
FIG. 37 is a detail perspective view of a collar type fitting mounted upon the top of a metal cylindrical column as attached to a brace element.

In FIG. 36 an arrangement is disclosed wherein the angle fitting 46 may be employed with a cylindrical metal column 136, and in FIG. 37 an arrangement is shown wherein a large dimension connector 44 encircles the upper end of the cylindrical metal column 136 and the large connector 44 is bolted to a smaller connector 44 encircling the brace element 40.

Figure 38:
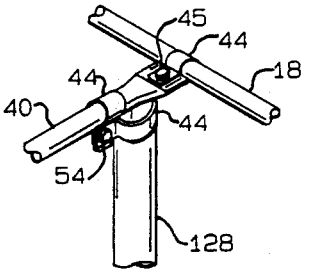
FIG. 38 is a detail perspective view of a collar type fitting mounted upon the top of a metal cylindrical telescoping column as used with marine installations as attached to a brace element.
Figure 39:
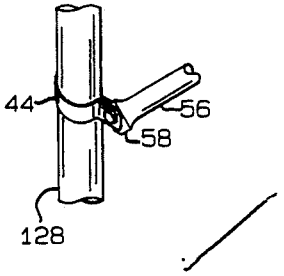
FIG. 39 is a detail perspective view of a collar type fitting as used with a brace arm and mounted upon a metal cylindrical telescoping column as used with marine installations.

FIG. 38 illustrates the type of fitting arrangement which may be used with the upper end of a marine column 128, and FIG. 39 illustrates the manner in which the lower end of a brace 56 may be attached to a marine column 128.

It will be appreciated that by the utilization of the angle fittings 46 and 60, and the desired size of a connector 44 that the canopy frame 12 may be readily supported upon any type of column.

The gable roof configuration of the canopy 10 in accord with the invention provides the canopy with sufficient strength to carry higher snow loads and the gable configuration provides advantageous wind drag characteristics. As the modular construction of the canopy permits the canopy frame to be readily disassembled into smaller components transportation and storage is significantly simplified with respect to presently available canopy constructions, and yet installers of ordinary skill are capable of understanding and implementing the necessary operations of assembly and disassembly. The use of the open end lacing hooks 68 permits the cover to be quickly and uniformly tensioned over the frame and by using simplified and standard fittings and connectors cost of components are reduced. As the connectors 44 used with the bracing arms and other canopy components may be of various sizes in order that the collar 47 properly fit the diameter of the tube being circumscribed, but regardless of the size of the connector collar the basic construction of the connector will remain the same.

It is appreciated that various modifications to the inventive concepts may be apparent to those skilled in the art without departing from the spirit and scope of the invention.

I claim:

1. A modular canopy system characterized by its versatility of assembly comprising, in combination, a pair of pre-assembled unitary integral identical canopy end sections each having a length and a width and formed by a plurality of tubular elements welded together, said sections each including first and second substantially parallel spaced lateral elements extending in the direction of the length of the sections and defining the sections' width, each of said lateral elements having an inner end, each of said sections including a tubular gable element located substantially centrally between said lateral elements and substantially parallel thereto and having an inner end, each of said sections including a plurality of tubular rib elements having ends, the ends of each of said rib elements being welded to said first and second lateral elements, respectively, said rib elements extending over and welded to the associated gable element and being substantially parallel to each other, and connection means defined on said inner ends of said lateral and said gable elements' selectively permitting said lateral and gable elements' inner ends of said pair of end sections to be interconnected to define a complete canopy frame.

2. In a modular canopy system characterized by its versatility of assembly, comprising, in combination, an integral pre-assembled canopy section formed of a plurality of tubular elements welded together and having a length and width, said section including spaced, substantially parallel first and second lateral elements extending in the direction of the length of the section and defining the section's width, said lateral elements each having at least one free connectable end, said section including a tubular gable element located substantially centrally between said lateral elements and substantially parallel thereto, at least one free connectable end defined upon said gable element, said section including a plurality of tubular rib elements having ends, said rib elements being substantially parallel to each other and substantially perpendicular to said lateral and gable elements and passing over said gable element and welded thereto, each of said rib elements' ends being welded to said lateral elements, said welded lateral, gable and rib elements comprising a unitary modular canopy section capable of being interconnected to similar canopy sections at said elements' connectable ends.

3. In a modular canopy system as in clam 2, said section comprising an end section for a canopy assembly, said end section including a tubular end element extending over said gable element and welded thereto, said end element constituting an extension of said lateral elements.

4. In a modular canopy system as in claim 2, said lateral and gable element free connectable ends selectively comprising a socket or socket insert.

5. In a modular canopy system as in claim 2, said canopy section having a longitudinal end as defined by the rib element closest said lateral and gable elements' connectable ends constituting an end rib element, said connectable end of said first lateral element extending beyond said end rib element a greater distance than the connectable end of said second lateral element, and said gable element connectable end extending beyond said end rib element a distance greater than that of said second lateral element and less than that of said first lateral element.

6. In a modular canopy system as in claim 2, said canopy section comprising a center section having lateral elements and a gable element, said center section lateral elements each having first and second free connectable ends, said gable element having first and second free connectable ends, said center section having a first longitudinal end defined by said elements' first ends and a second longitudinal end defined by said elements' second ends.

7. In a modular canopy system as in claim 6, said lateral and gable elements being of substantially equal length and longitudinally offset with respect to each other whereby a first plane containing said first ends is obliquely related to the section length and a second plane containing said second ends is obliquely related to the section length and parallel to said first plane.

8. In a canopy assembly including a substantially rigid canopy framework for supporting a flexible fabric cover superimposed over the framework, the framework including intersecting lateral and end elements defining corners, the cover including a skirt extending downwardly and below the lateral and end elements, the skirt defining internal corners at the intersection of the lateral and end elements, the improvement comprising, a cover skirt stabilizer located within the internal corners of the cover skirt, said stabilizer including an elongated member having upper and lower ends and a length less than the vertical dimension of the cover skirt, fastening means attaching said member upper end to a canopy framework element adjacent a framework corner whereby said member extends downwardly from the framework corner and is located within the associated skirt internal corner, and at least one adjusting brace interposed between each of said skirt stabilizer members and an adjacent framework element to adjust and maintain a predetermined angular orientation of said members to the canopy framework to retain the cover skirt oriented relative to the framework.

9. In a canopy assembly as in claim 8, said adjusting brace comprising an elongated arm having a first end attached to said stabilizer member intermediate said member ends and a second end attached to an adjacent framework element.

10. In a canopy assembly as in claim 9, first adjustable fastening means mounted on said arm first end and second adjustable fastening means mounted on said arm second end whereby said arm ends may be selectively adjusted with respect to said stabilizer member and associated framework element, respectively.

11. In a canopy assembly as in claim 8, a pair of adjusting braces interposed between each of said skirt stabilizer members and the adjacent canopy framework elements, one of said braces being attached to a lateral element and the other brace being attached to an end element.

12. In a canopy assembly as in claim 11, each of said adjusting braces comprising an elongated arm having a first end adjustably attached to said stabilizer member intermediate said member ends and a second end adjustably attached to the associated framework element.

13. A canopy system comprising, in combination, a gabled canopy frame formed of interconnected elongated elements and having a width, a length and a perimeter, said frame width being defined by lateral elements, said frame length being defined by end elements, said lateral and end elements defining said frame perimeter, a plurality of parallel spaced rib elements interposed between said lateral elements, said rib elements having ends welded to said lateral elements, said lateral, end and rib elements including upper and lower portions, first lacing fittings mounted upon the lower portions of said rib elements spaced from said lateral and end elements, a flexible cover disposed over said canopy frame and said elements upper portion, said cover having a peripheral edge and a peripheral region adjacent said peripheral edge, second lacing fittings defined in said cover adjacent said peripheral edge, said cover peripheral region passing under said lateral and end elements lower portion, lacing interconnecting said first and second lacing fittings tensioning said cover upon said canopy frame, a cover skirt defined on said cover peripheral region extending downwardly and below said lateral and end elements, said skirt defining internal corners at the intersection of said lateral and end elements, a cover skirt stabilizer located within said internal corners of said cover skirt, said stabilizer including an elongated member having upper and lower ends and a length less than the vertical dimension of said cover skirt, fastening means attached said member upper end to a canopy frame element adjacent the intersection of said lateral and end elements whereby said member is located within a skirt internal corner, and at least one adjusting brace interposed between each of said skirt stabilizer members and an adjacent frame element to adjust and maintain a predetermined angular orientation of said member to said canopy frame to retain said cover skirt oriented relative to said frame.

14. In a canopy system as in claim 13, said rib elements including end rib elements adjacent said frame end elements and parallel to said adjacent frame end elements, a plurality of first lacing fittings defined on said lower region of said end rib elements spaced form adjacent first lacing fittings a distance substantially equal to the spacing between adjacent rib elements.

15. In a canopy system as in claim 14, said first lacing fittings being located on said rib elements lower regions a distance form the nearest lateral element substantially equal to the distance of said end rib elements from the adjacent frame end element.

16. In a canopy system as in claim 15, said first lacing fittings comprising hooks affixed to said rib elements and said end rib elements lower regions.

17. In a canopy system as in claim 13, said adjusting brace comprising an elongated arm having a first end attached to said retainer member intermediate said member ends and a second end attached to an adjacent frame element.

* * * * *